US006178250B1

(12) United States Patent
Brungart et al.

(10) Patent No.: US 6,178,250 B1
(45) Date of Patent: Jan. 23, 2001

(54) ACOUSTIC POINT SOURCE

(75) Inventors: Douglas S. Brungart, Beavercreek, OH (US); William M. Rabinowitz, Bedford, MA (US)

(73) Assignee: The United States of America as represented by the Secretary of the Air Force, Washington, DC (US)

( * ) Notice: Under 35 U.S.C. 154(b), the term of this patent shall be extended for 0 days.

(21) Appl. No.: 09/168,339

(22) Filed: Oct. 5, 1998

(51) Int. Cl.[7] ..... H04R 25/00

(52) U.S. Cl. ..... 381/337; 381/67; 381/338; 381/382; 181/131; 181/137

(58) Field of Search ..... 381/60, 67, 338, 381/370, 380, 382, 337; 600/559; 181/129, 130, 131, 135, 137; 128/715; D24/134

(56) References Cited

U.S. PATENT DOCUMENTS 2,328,169 * 8/1943 Schindler ..... 381/67
4,534,058 * 8/1985 Hower ..... 381/67
5,327,506 * 7/1994 Stites ..... 381/338
5,347,583 * 9/1994 Dieken et al. ..... 381/67
5,440,639 8/1995 Suzuki et al. .
5,500,900 3/1996 Chen et al. .
5,521,981 5/1996 Gehring .
5,561,275 * 10/1996 Savage et al. ..... 181/131
5,715,317 2/1998 Nakazawa .

* cited by examiner

*Primary Examiner*—Curtis A. Kuntz
*Assistant Examiner*—Suhan Ni
(74) *Attorney, Agent, or Firm*—Gina S. Tollefson; Gerald B. Hollins; Thomas L. Kundert

(57) ABSTRACT

Acoustic point source transducer apparatus including a high-output acoustic sound source propagating sound through a long, flexible tubing having an open end with a small diameter. Sound radiates from the small diameter open end effectively acting as an acoustic point source. A flexible sleeve encasing the terminal end of the tubing permits convenient wand-like placement of the acoustic point source by a human operator and an electromagnetic position sensor at the small diameter open end determines point source position. The invention provides a convenient, nondirectional approximated acoustic point source for improved acoustic measuring, especially desirable for near-field Head-Related Transfer Function measuring.

3 Claims, 3 Drawing Sheets

ACOUSTIC POINT SOURCE

RIGHTS OF THE GOVERNMENT

The invention described herein may be manufactured and used by or for the Government of the United States for all governmental purposes without the payment of any royalty.

BACKGROUND OF THE INVENTION

The field of the invention is acoustic measuring and more specifically generating an acoustic signal issuing from a compact region in space.

Under certain circumstances, it is desirable to make acoustic measurements with an acoustic "point source". A point source is defined as an infinitesimally small sound source that produces a finite quantity of acoustic power. Usually it is modeled as a pulsating sphere of negligible dimensions producing a finite volume velocity at its surface.

A conventional transducer for generating an acoustic signal from an electrical input is a loudspeaker. Head-Related Transfer Function (HRTF) measurements, which measure the transformation of a sound wave by the head, torso, and ear as it propagates from an external source to the eardrum, have traditionally used conventional loudspeakers, 7 cm or larger in diameter, to generate the acoustic stimulus. At distances of 1 m or more, such loudspeakers are perfectly adequate. At close distances there are serious problems associated with loudspeaker-based measurements. The precise location of a loudspeaker, for example, is not well defined in the near-field. The stimulus is generated by the entire diaphragm of the loudspeaker, and at close distances this may extend over a large region of space: at 12 cm, for example, a 7 cm loudspeaker covers an arc in excess of 30 degrees. The HRTF measured will therefore be, in effect, the average HRTF over the entire region covered by the loudspeaker. Additionally, the directional properties of the loudspeaker may taint the HRTF. When the speaker is near the listener, the high-frequency directionality of the speaker will also cause the sound pressure reaching the head and torso to vary according to the orientation of that region relative to the speaker, This may significantly affect the measured HRTF. While it is possible to build a small loudspeaker, there is a trade-off in loudspeaker design between small size and low-frequency output.

The axial response of a loudspeaker is complicated by its distributed geometry at very close distances. At distances less than $2\,a/\lambda$, where a is the radius of the loudspeaker and $\lambda$ is the wavelength of the sound, the intensity along the axis of the loudspeaker does not decrease monotonically with distance, but rather passes through a series of maxima with intervening nulls. For a 15 kHz sound generated by a 7 cm loudspeaker, this effect complicates HRTF measurements at distances less than 10 cm from the surface of the head (approximately 20 cm from the center of the head).

A loudspeaker is also generally large enough to provide a reflective surface when placed sufficiently close to the head. Sound generated by the speaker may be reflected off the head, then be reflected again off the loudspeaker source and back toward the head. These second-order reflections could additionally corrupt a near-field HRTF measurement.

For at least these reasons, an ordinary loudspeaker cannot be used effectively to make near-field HRTF measurements. A key to eliminating the problems associated with loudspeaker measurements is reducing the effective area of the source, i.e., providing an acoustic "point source". Point sources have two important characteristics which cannot be duplicated in any physically realizable acoustic transducers. They radiate sound from a single location in space; and they radiate sound omnidirectionally. Unfortunately, it is impossible to build an infinitesimally small sound transducer with these characteristics. Every realizable transducer has finite dimensions, and therefore generates a positive particle velocity over some finite region of space. The sound pressure generated by such a source at a particular location in space is found by dividing the surface of the source into infinitesimal regions. The contribution of each region is determined by assuming that region is a point source with a certain volume velocity. The surface integral of these contributions over the area of the transducer determines the total signal. In acoustic measurements of the transfer function from a sound source at a particular location in space to a receiver at some other location in space, any measurement with a conventional transducer will in fact be the average transfer function over the region covered by the transducer. In order to control the exact location of a sound source, it is necessary to make the area of the transducer as small as possible.

One possible approach to this problem is the use of small loudspeakers. This would certainly reduce the problems of location, directionality, axial response, and reflections described above. However, due to radiation impedance considerations, there is an inverse relation between the efficiency of a loudspeaker at low frequencies and the size of the loudspeaker. Thus extremely small loudspeakers cannot effectively reproduce wide-band stimuli inclusive of low frequency content.

A second approach to the acoustic point source problem is to generate a wideband stimulus with a relatively large conventional cone loudspeaker and connect this speaker, through an enclosed cavity, to a small diameter metal tube. The sound then propagates down the tube and radiates from the small orifice at the opening of the tube. There are three reasons why this type of system cannot generate low frequency sounds. First, conventional loudspeakers radiate inefficiently when the wavelength of the sound is large relative to the diameter of the speaker, and a conventional cone loudspeaker is simply not powerful enough to produce much output below 1 kHz. Second, it is difficult to prevent low-frequency energy from leaking out of the loudspeaker enclosure. It generally requires massive barriers to prevent the propagation of sound at low frequencies. Such a large and massive source would be unwieldy at best and still would not eliminate the problem of secondary reflections off of the source.

A third way to simulate an acoustic point source consists of a stretched, round membrane which is driven only at its center. If the membrane material is chosen carefully, vibrations propagate down the membrane at the same speed the sound waves propagate in air. This results in a hemispherically symmetrical sound radiation pattern. While this system approximates an acoustic point source, it still apparently requires a round membrane which may reflect scattered sound waves. Also, this system cannot be adapted from commercially available components.

The present invention overcomes problems in the art by generating sound from a compact region of space which is both largely nondirectional at relatively high frequencies and relatively powerful at low frequencies, and is also equipped with an electromagnetic position sensing system that allows accurate measurement of the effective position of the source relative to a reference point.

SUMMARY OF THE INVENTION

An acoustic point source transducer apparatus including a high-output acoustic sound source which propagates sound through a long, flexible tube having an open end with a small diameter. Sound radiates from the small diameter open end of the tube which is effectively acting as an acoustic point source. A flexible sleeve encasing the terminal end of the tubing permits convenient wand-like placement of the acoustic point source by a human operator and an electromagnetic position sensor at the small diameter open end determines point source position relative to a point of reference.

It is an object of the invention to provide an acoustic point source which produces nondirectional acoustic signals over a wide frequency range.

It is another object of the invention to provide an acoustic point source which generates sound from a compact region of space.

It is another object of the invention to provide an acoustic point source which is free from effects of sound leakage at the sound source.

It is another object of the invention to enhance the accuracy of acoustic measurements.

It is another object of the invention to provide an acoustic point source capable of convenient manual placement.

It is another object of the invention to measure the effective location of an acoustic point source without interfering with its acoustic output.

These and other objects of the invention are described in the description, claims and accompanying drawings and are achieved by an acoustic point source transducer apparatus comprising:

an acoustic sound source; and a sound propagating flexible passage having a first end and a second open end of small diameter, said first end connected to said acoustic sound source and said second end of small diameter radiating sound therefrom.

DETAILED DESCRIPTION

Figure 1:
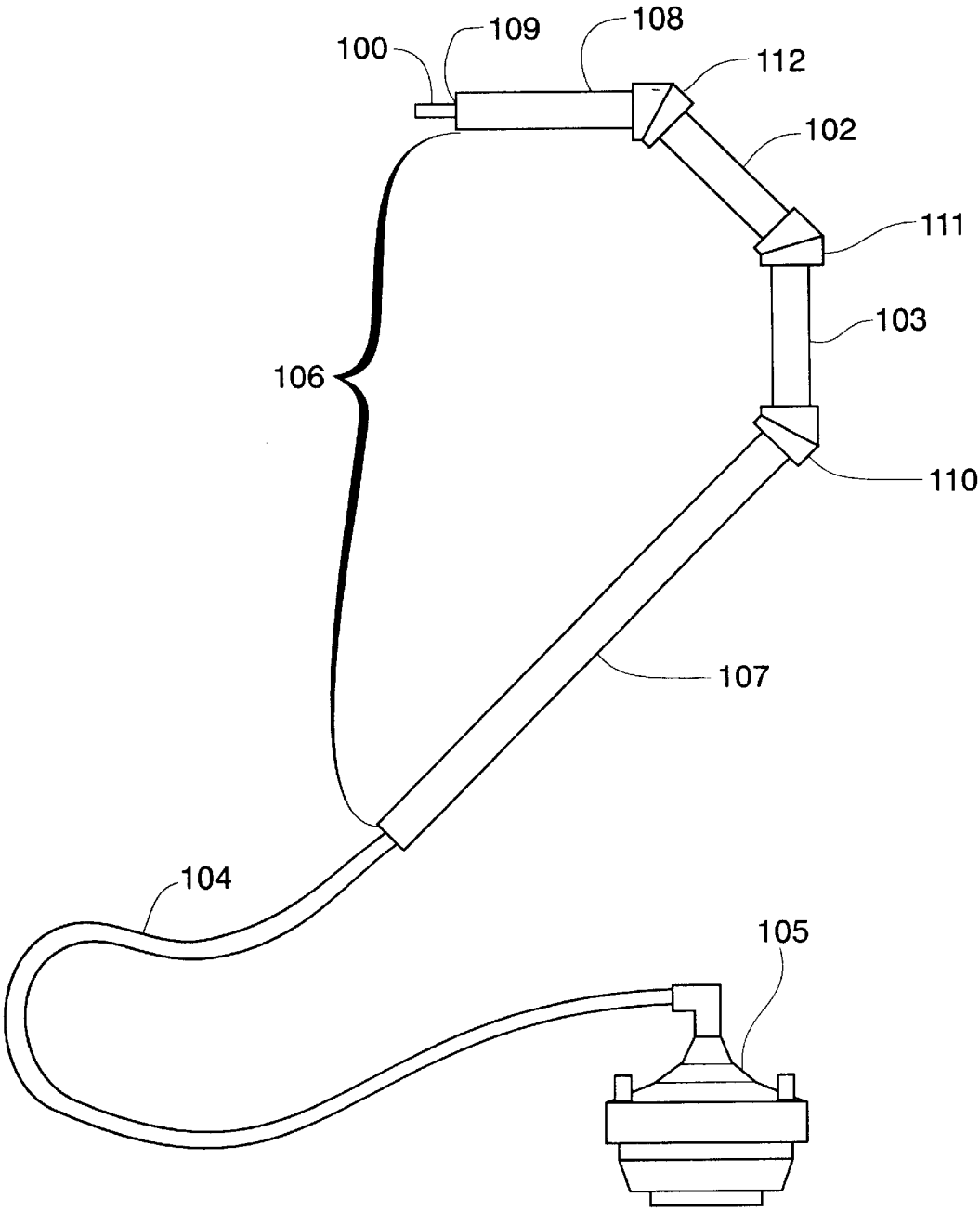
FIG. 1 shows the system of the invention.

The system of the invention is shown in FIG. 1. The components of the system include a high-output acoustic driver 105, flexible tubing 104, a wand 106 covering a large portion of the tubing 104 and an electromagnetic position sensor 100. In operation, the acoustic driver 105 generates an acoustic signal which propagates the length of the flexible tubing 104 and radiates through a small 1.3 centimeter diameter opening 109 of the tubing 104, to form an approximated point source of acoustic sound. The frequency range of the sound radiated from the FIG. 1 point source can extend over the range of 200 Hz to 15 kHz and provide a 3 decibel beam-width of approximately 120 degrees at 15 kHz. An electromagnetic position sensor 100 measures the effective location of the point source 109 without interfering with its output.

Figure 3:
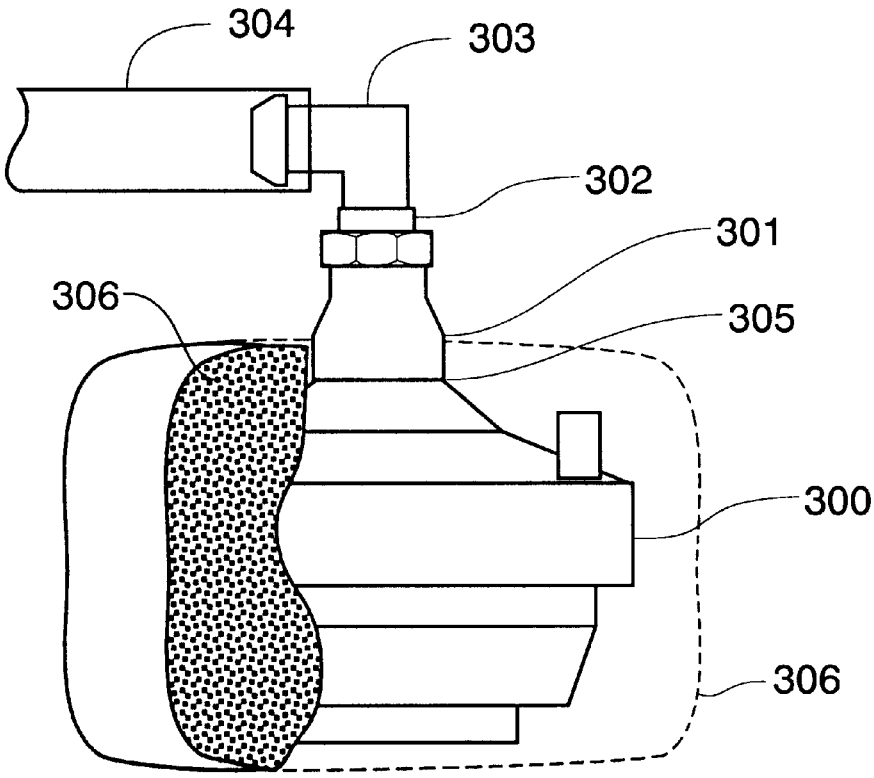
FIG. 3 shows a high-output acoustic driver.

FIG. 3 shows a detailed view of a high-output acoustic driver 300. A commercially available electrodynamic driver unit such as a DH1506 driver made by Electro-Voice may be used. Ordinarily, the Electro-Voice driver is used in conjunction with a large exponential horn in high-output public address systems. When connected to such a horn, the driver is capable of generating loud signals and has a frequency response range from 500 Hz to 3 kHz with a controlled roll-off to 20 kHz. In the system of the invention, the driver 300 is not connected to a horn, but rather is connected directly to a length of long flexible tubing, a cut-off portion of which is shown at 304. The diameter of the opening 305 of the driver 300 is 3.5 centimeters, a diameter larger than the diameter of the flexible tubing 304, 104 so a series of fittings are required to mate the tubing 304 to the driver 300. A 1 inch to 1.5 inch copper tubing connector 301 may, for example, be mounted over a threading surrounding opening 305 of the driver 300. Teflon® pipe-fitting tape can be used to fill the gap between the driver opening 305 threaded ring and the smooth-walled copper fitting 301. A ¾ inch to 1 inch brass brushing 302 fits into the copper fitting 301 with the aid of additional Teflon® tape and is connected directly to a ½ inch to ¾ inch hose fitting 303 which also acts as a right angle adapter. Flexible tubing at 304 is then mated with the right angle adapter 303.

The driver 300 is a high-output acoustic transducer which is the sound generator for the arrangement of the invention. The sound is ultimately radiated from the FIG. 1 opening 109 of the flexible tubing 104. The driver assembly 300, 105, however, generates some sound at its relative location due to acoustic energy leakage from the back of the driver, especially in the frequency range of 8–9 kHz. The entire driver assembly may be wrapped in sound absorbent material, shown at 306, such a closed cell rubber foam, to ensure that any sound leaking from the driver unit is isolated from the open end of the point source.

Commercially available tubing such as Tygon® transparent tubing is connected to the driver 300 by adapter 303. Ideally, the tubing has an internal diameter of 1.3 centimeters and a wall thickness of 0.3 centimeters. The tubing shown at 104 in FIG. 1 is 3.5 meters in length. FIG. 1 shows at 104 that the first 2.3 meters of the tubing are openly exposed. The next 1.2 meters of tubing are encased in a sleeve constructed of, for example, polyvinylchloride pipe with an internal diameter of 2.5 centimeters. The plastic wand, shown in its entirety at 106 in FIG. 1, includes four straight lengths of pipe 107, 103, 102 and 108 and 45 degree elbow fittings 110, 111 and 112. The wand 106 acts as a placement wand and provides accurate and convenient placement of the point source 109 when required. The curvature of the placement wand 106 allows, for example, a manual use of the invention wherein a human operator stands in a fixed location approximately 1 meter away from a receiver (a human subject, for example), and moves the point source to any location within 1 meter of the receiver.

The 135 degree bend in the placement wand 106 enables the operator to keep the source oriented in the direction of the receiver, eliminating any undesirable effects due to source directionality at high frequencies. That is, the approximated point of sound radiation is sufficiently small that the receiver perceives the sound to arrive from no particular direction. This perception exists if the open end of the flexible tubing, the point source, is directing upward, downward, backward or forward relative to the receiver.

Figure 2:
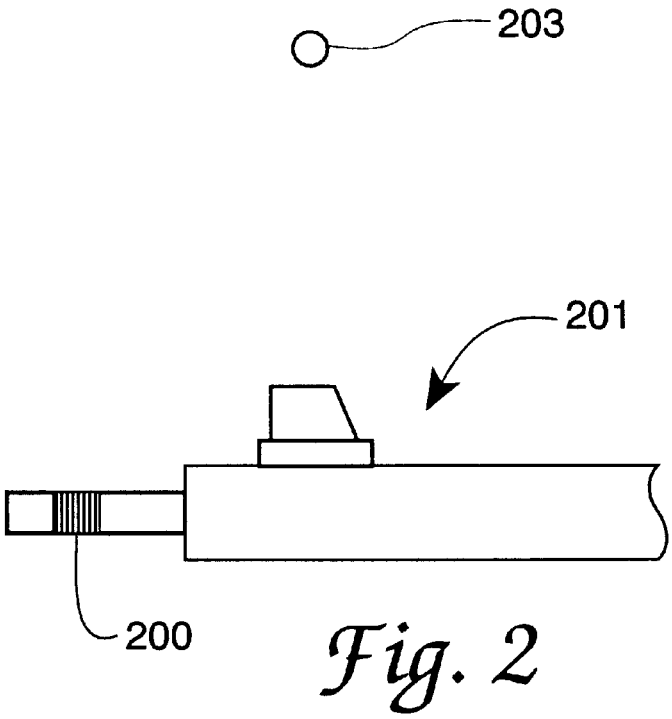
FIG. 2 shows an electromagnetic position sensor system.

The electromagnetic sensor shown at 201 in FIG. 1 is shown in an enlarged view in FIG. 2. The electromagnetic sensor allows an off-line control computer to determine the exact location of the point source rapidly even when the FIG. 1 and FIG. 2 apparatus is manually placed by a human operator. The electromagnetic sensor 201 is capable of determining the location of the sensor relative to a separate electromagnetic reference point 203 within 0.25 centimeters in x, y and z coordinates and the orientation of the sensor within 0.1 degrees in roll, pitch and yaw.

The electromagnetic sensor is positioned with respect to the other elements in FIG. 1 so that it remains in a fixed location relative to the opening of the tube 109, the effective location of the point sound source. The center of the sensor is located a predetermined offset above and behind the opening 109 of the tubing, and this predetermined offset, along with the orientation and position information from the electromagnetic sensor, can be used to determine the exact location of the opening of the tube. Any commercially available sensor may be used such as a Polhemus Electronics 3-Space Tracker. The position of the opening 109 of the tube, or the effective point source, can be found with respect to a sensing reference point 203 in FIG. 2 for example, from the x, y and z and roll (r1), pitch (e1) and yaw (az) coordinates produced by the 3-dimensional tracker by using the following equations wherein the above offset is 4 centimeters above and 6 centimeters behind opening 109 of the tubing.

$$x_{opening}=x_{sensor}+6\cos(az)\cos(el)+4(\cos(az)\sin(el)\cos(rl)+\sin(az)*\sin(rl)) \quad \text{Eq. 1}$$

$$y_{opening}=y_{sensor}+6\sin(az)\cos(el)+4(\sin(az)\sin(el)\cos(rl)-\cos(az)*\sin(rl)) \quad \text{Eq. 2}$$

$$z_{opening}=z_{sensor}-6\sin(el)+4\cos(el)\cos(rl) \quad \text{Eq. 3}$$

Figure 4:
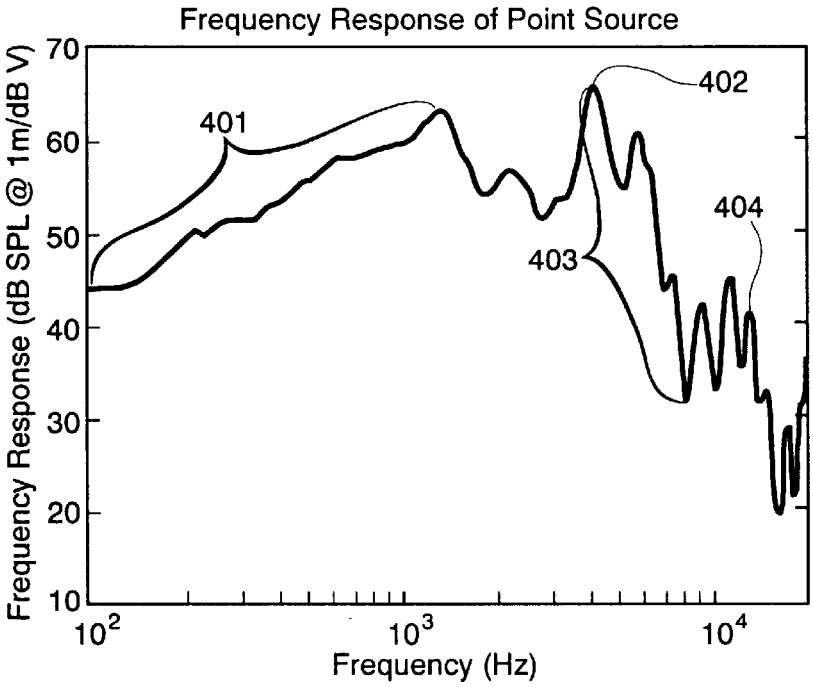
FIG. 4 shows the frequency response of the acoustic point source of the invention.

A typical frequency response of the FIG. 1 system is shown in FIG. 4. The x-axis of the graph of FIG. 4 represents frequency in Hertz and the y-axis represents output level at a distance of 1 m in decibels SPL for an input level of 1 Volt. These measurements were made in an anechoic chamber using a periodic chirp stimulus and a 1024-point fast Fourier transform. Due to the unconventional tubing 104 transmission path from the driver to the opening of the tube, the frequency response of the system is somewhat erratic. The response slopes gently upward from 200 Hz to 1 kHz, as shown at 401 in FIG. 4. The response then includes four local maxima up to 6 kHz shown at 402. Above 6 kHz the frequency response drops suddenly by 30 decibels, shown at 403, and stays at this lower level with several more local maxima until dropping dramatically again at 15 kHz, shown at 404. Although somewhat erratic, the transfer function is stable to changes in the configuration of the Tygon®tubing, so the point source, 109 in FIG. 1, can be moved without changing the response characteristics.

The irregular frequency response of the apparatus seemingly limits the use of the point source directly in some applications, but it is generally possible to compensate for the irregular response. In acoustic measurements, the stability of the transfer function allows it to be completely removed from a measurement. For example, in measuring HRTFs, the desired quantity under test is the ratio of sound-pressure at the eardrum to the free-field sound pressure at the center of the head. As such, the point source can be used without spectral compensation because the point source transfer function is present in both measurements and is eliminated when the ratio between the measurements is calculated. It is also possible to compensate for the irregular response by shaping the spectrum of the input signal with the inverse transfer function of the source. This technique has been used to produce a signal with a uniform frequency response (+−0.5 decibel) from 200 Hz to 15 kHz.

Figure 5:
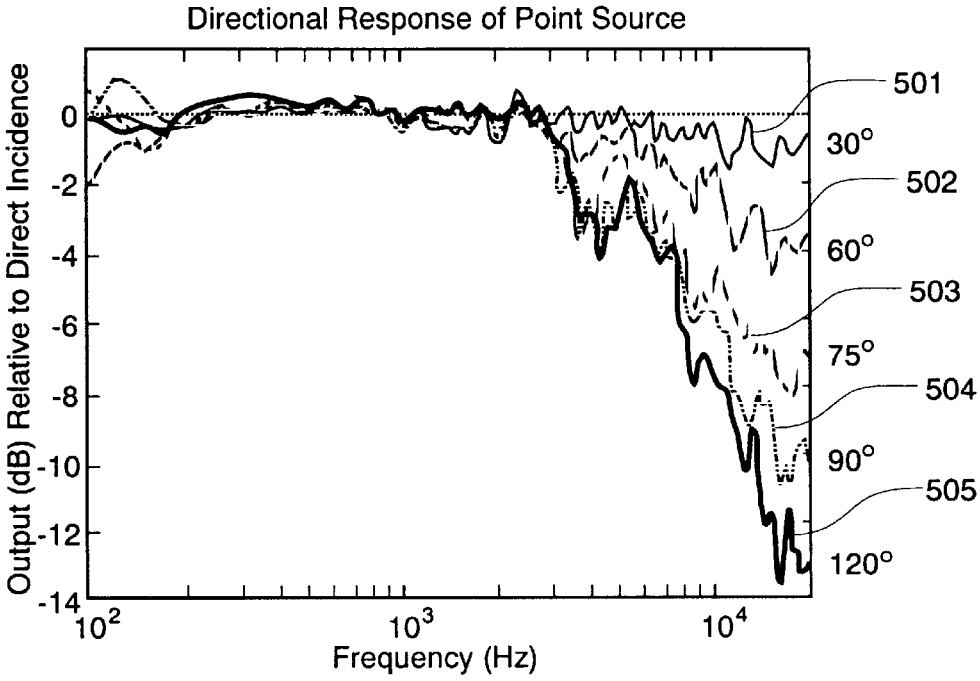
FIG. 5 shows the directional response of the acoustic point source of the invention.

FIG. 5 shows the directional response of the acoustic point source of the invention. The x-axis of the graph of FIG. 5 represents frequency in Hertz and the y-axis represents the acoustic point source output in decibels relative to direct incidence. FIG. 5 shows the frequency response of the point source at five source directions, represented by curves at 501, 502, 503, 504 and 505 relative to a normal incidence. The measurements were made in an anechoic chamber using a periodic chirp stimulus and a 1024-point fast Fourier transform. As expected, high-frequency sound radiated by the sound source drops off as the source is rotated from normal incidence. Note, however, that in the frequency range of interest (200 Hz to 15 kHz) the source has a 3 decibel beam-width in excess of 120 degrees. Also note that the directional properties of the source are largely governed by the internal diameter of the tube, and that the directionality of the source can be reduced by decreasing the tube diameter at the expense of reduced output level.

The acoustic point source transducer apparatus is a compact, nondirectional, high-output point source for use in acoustic measuring. The long tube between the driver and the opening of the point source allows its opening to be acoustically isolate from the acoustic driver by placing the driver unit relatively far from the tube opening, by wrapping the source in sound absorbent material, or both. A rigid wand allows for convenient placement of the source. Effective tracking of the point source is possible without interfering with point source output. The apparatus is especially suited to use with relatively long noise-like signals due to the long and complicated impulse response of the system.

While the apparatus and method herein described constitute a preferred embodiment of the invention, it is to be understood that the invention is not limited to this precise form of apparatus or method and that changes may be made therein without departing from the scope of the invention which is defined in the appended claims.

We claim:

1. An acoustic point source transducer apparatus comprising:

an original sound generating high output acoustic driver; and a sound propagating flexible passage encased in a rigid, wand-like sleeve defining a hook-like shape allowing manual placement by a stationary human operator over a hemispherical-shaped area, comprising three 45 degree elbow-joints interspersed between four rigid straight lengths of pipe an allowing easy manipulation of the location of said opening without interfering with sound propagation in said flexible passage having a first end and a second open end of small diameter, said first end connected to said original sound generating high output acoustic driver and said second end of small diameter radiating sound therefrom.

2. An acoustic point source transducer apparatus comprising:

an original sound generating high output acoustic driver; and a sound propagating flexible passage encased in a rigid, 1.2 meter length, wand-like, polyvinylchloride sleeve having a first end and a second open end of small diameter and comprising three 45 degree elbow-joints interspersed between four rigid straight lengths of pipe defining a hook-like shape allowing manual placement by a stationary human operator over a hemispherical-shaped area, and allowing easy manipulation of a location of said opening without interfering with sound propagation in said flexible passage, said first end connected to said original sound generating high output acoustic driver and said second end of small diameter radiating sound therefrom.

3. An original sound directionality independent portable acoustic point source transducer apparatus comprising:

an original sound generating high-output electrodynamic horn driver sound source;

sound propagating material surrounding said sound source;

a sound propagating flexible tubing having a first end connected to said sound source and a second sound radiating open end of small diameter in distal proximity to said sound source, said second sound radiating open end approximating a point source of acoustic sound;

a wand-like polyvinyl chloride sleeve having four straight lengths of pipe comprised of polyvinyl chloride connected by three 45-degree elbow joints defining a curvature and encasing a portion of said flexible passage for convenient manual placement over a hemispherical-shaped area by a stationary human operators; and a linear and angular position determining electromagnetic sensor attached to said second open end of said flexible passage.

* * * * *

UNITED STATES PATENT AND TRADEMARK OFFICE

CERTIFICATE OF CORRECTION

PATENT NO. : 6,178,250 B1
DATED : January 23, 2001
INVENTOR(S) : Douglas S. Brungart et al.

It is certified that error appears in the above-identified patent and that said Letters Patent is hereby corrected as shown below:

Column 1,
Line 41, the comma should be a period.

Column 4,
Line 61, "201" should read --- 100 ---.
Line 62, "shown in" should read --- shown at 201 in ---.

Column 6,
Line 20,"isolate" should read --- isolated ---.
Line 44, "an" should read --- and ---.

Column 8,
Line 1, "straight" should read --- rigid straight --.
Line 7, "operators" should read --- operator ---.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*